US007215245B2

(12) United States Patent
Lee

(10) Patent No.: US 7,215,245 B2
(45) Date of Patent: May 8, 2007

(54) ACTIVATOR CIRCUIT RESPONSIVE TO POWER LINE DISTURBANCES

(76) Inventor: Fu Ching Lee, 351 W. Martin Luther King Jr Blvd., Los Angeles, CA (US) 90037

( * ) Notice: Subject to any disclaimer, the term of this patent is extended or adjusted under 35 U.S.C. 154(b) by 169 days.

(21) Appl. No.: 11/140,089

(22) Filed: May 31, 2005

(65) Prior Publication Data

US 2006/0267757 A1 Nov. 30, 2006

(51) Int. Cl.
*G08B 1/08* (2006.01)

(52) U.S. Cl. ..... 340/538.12; 340/538.16; 340/310.13; 340/310.17; 340/635

(58) Field of Classification Search ..... 340/538.12, 340/538.16, 310.13, 310.17, 635, 538.11, 340/310.11, 310.18, 310.12, 657; 307/91, 307/18; 324/67; 370/290; 375/318; 333/124
See application file for complete search history.

(56) References Cited

U.S. PATENT DOCUMENTS 3,818,481 A * 6/1974 Dorfman et al. ..... 340/538.11
4,287,517 A 9/1981 Nagel
4,313,110 A 1/1982 Subulak et al.
5,186,653 A 2/1993 Robert
5,422,629 A 6/1995 Minnis
5,438,317 A * 8/1995 McMaster ..... 340/550
5,859,584 A * 1/1999 Counsell et al. ..... 340/538
5,952,914 A * 9/1999 Wynn ..... 370/290
6,157,292 A * 12/2000 Piercy et al. ..... 375/130
6,326,880 B1 12/2001 Tice
6,642,849 B1 11/2003 Kondziolka
6,762,688 B2 7/2004 Johnson et al.

* cited by examiner

*Primary Examiner*—Anh V. La

(57) ABSTRACT

An activator circuit responsive to power line disturbances. In condition of false alarm, the user will toggle a local light switch causing electrical disturbances on the power line. The activator circuit detects these disturbances and activates an output, which is further connected to the silence function on the detector, silencing the false alarm. The activator circuit comprising a power line interface circuit, a signal conditioning circuit, a threshold detector circuit, a pulse train comparison circuit and an output circuit.

5 Claims, 2 Drawing Sheets

ACTIVATOR CIRCUIT RESPONSIVE TO POWER LINE DISTURBANCES

CROSS-REFERENCE TO RELATED APPLICATION

Not Applicable

FEDERALLY SPONSORED RESEARCH

Not Applicable

SEQUENCE LISTING OR PROGRAM

Not Applicable

FIELD OF INVENTION

The present invention relates to an activator circuit. More particularly, the invention pertains to an activator circuit with a controllable output circuit, which is responsive to power line disturbances.

BACKGROUND OF INVENTION

Ambient condition detectors, such as smoke, and fire alarms etc., are widely known in the arts. Such detectors are now more commonly line powered with battery power as backup. Detectors often experience false alarms as a result of smoke from cooking, smoking and other non-threatening situations. For this purpose, many modern detectors include a silencing feature or hush mode. This is typically implemented as a push button on the detector unit. In the event of a false alarm, the user will depress this push button to silence the alarm for a period of time. These false alarms are minor inconveniences if the user was able to silence the alarm easily, however, in cases of line powered detectors, they are usually mounted high up on ceilings where it would be difficult for the user to silence the alarm making a minor inconvenience into a major nuisance.

Prior art shows a number of methods and apparatus to solve this issue. U.S. Pat. No. 6,762,688 B2 shows a system whereby it would be possible for a user to use an IR remote control unit to silence the alarm. This solves the physical problem in silencing the alarm, however, another problem is created since the user has to have a remote control unit at hand.

There continue to be a need for inexpensive and effective circuitry, which can be used to remotely silence a detector in the event of a false alarm. Preferably without the need for specialized remote controls.

SUMMARY OF THE INVENTION

An activator circuit responsive to power line disturbances. In condition of false alarm, the user will toggle a local light switch causing electrical disturbances on the power line. The activator circuit detects these disturbances and activates an output, which is further connected to the silence function on the detector, silencing the false alarm.

The activator circuit comprising a power line interface circuit, a signal conditioning circuit, a threshold detector circuit, a pulse train comparison circuit and an output circuit.

Thereby a false alarm can be remotely silenced without the need for specialized remote controls.

These and other aspects and attributes of the present invention will become readily apparent from the following detailed description of the invention and the embodiments thereof, from the claims, and from the accompanying drawings.

DETAILED DESCRIPTION OF THE PREFERRED EMBODIMENTS

Figure 1:
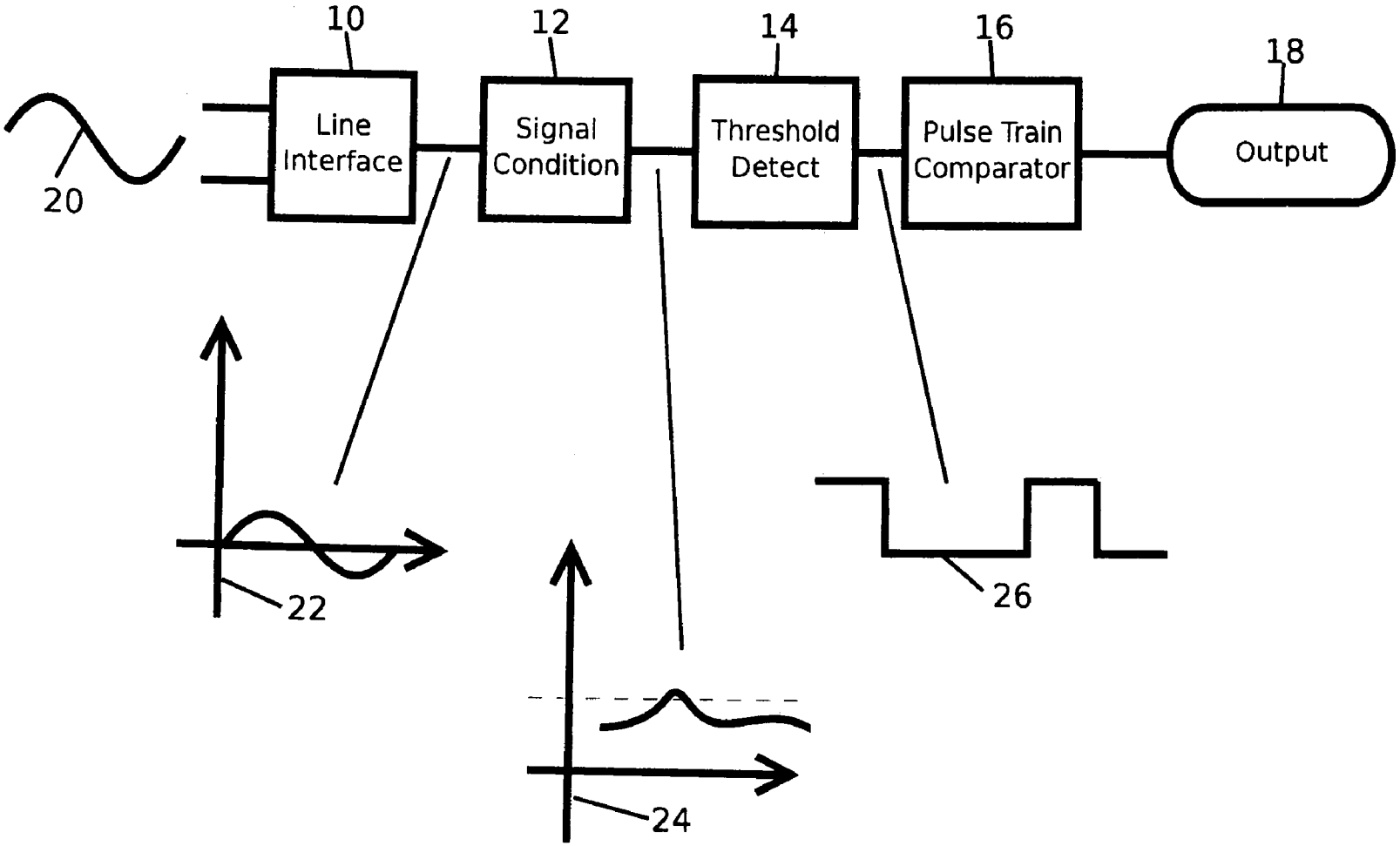
FIG. 1 is a block diagram illustrating the present invention.

While this invention is susceptible of embodiment in many different forms, there is shown in the drawings and will be described herein in detail specific embodiments thereof with the understanding that the present disclosure is to be considered as an exemplification of the principles of the invention and is not intended to limit the invention to the specific embodiments illustrated.

FIG. 1 illustrates a block diagram of the present invention. Power line signal 20 is coupled into the circuit via the line interface circuit 10. The line interface circuit 10 transforms the power line signal 20 to a low level signal 22. This low level signal 22 is of a range to not damage common electronic components. The line interface circuit 10 could be implemented as a step-down transformer as would be understood by those of skill in the art.

Figure 2:
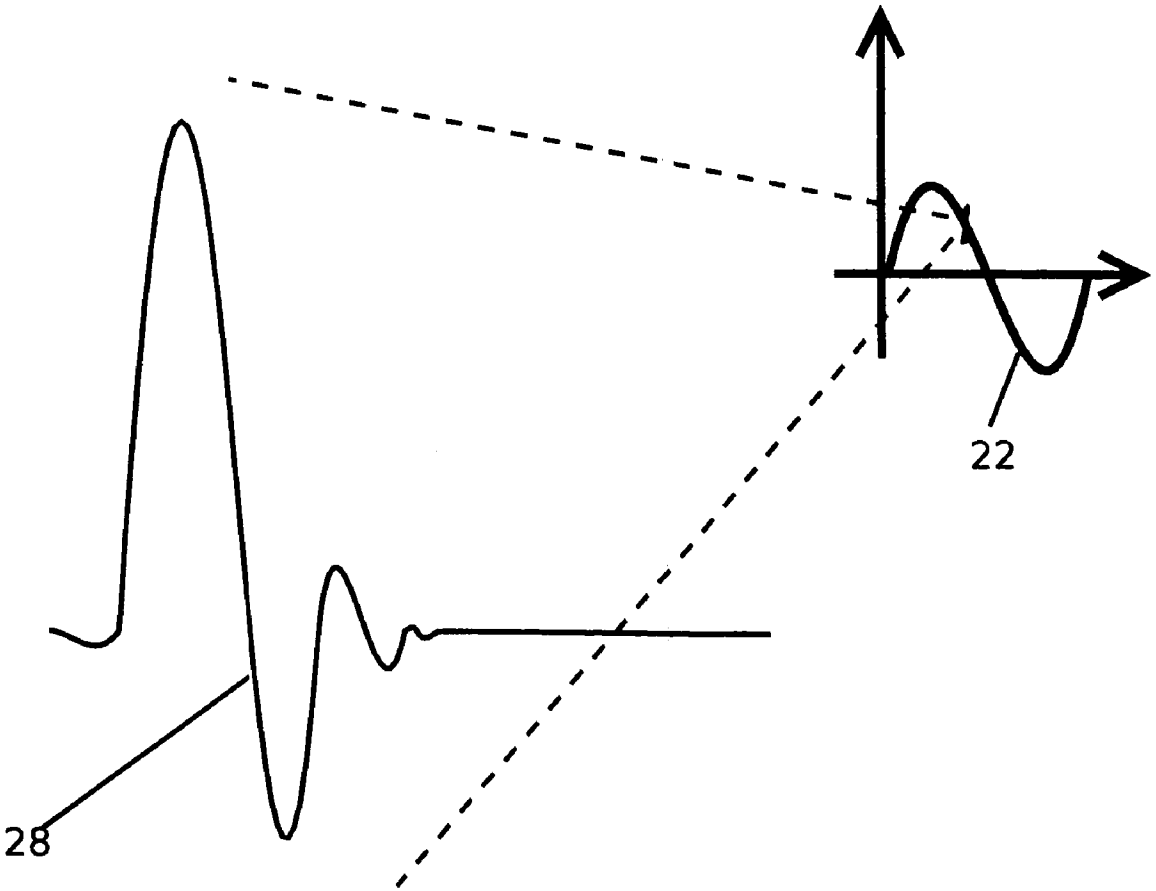
FIG. 2 is a representation of a power line disturbance.

If an inductive load is switch on or off, a disturbance would be caused to be imparted onto the power line signal. FIG. 2 shows a representation of such a signal after passing through the line interface circuit 10. The disturbance signal 28 comprises an initial high impulse gradually decaying (ringing) to zero. The absolute amplitude of disturbance 28 is determined by the wiring parameters of the power line. Things such as length of wire and type, the inductive load and the speed of cut of the switch contribute to the composition of the absolute amplitude. The frequency of ringing is also determined by these factors. The disturbance signal 28 rides on the low level signal 22. The amplitude of the disturbance signal 28 is in practice much smaller than the amplitude of the low level signal 22.

The low level signal 22 is passed into the signal conditioning circuit 12 where the disturbance signal 28 will be extracted. The signal conditioning circuit 12 comprising of a rectifier, high pass filter and amplifier circuits as would be understood by those of skill in the art.

The output of the signal conditioning circuit 12 is reduced to the DC level signal 24. DC level signal 24 is predominately a DC level. When the disturbance signal 28 is encountered, a corresponding pulse is observed on the DC level signal 24.

The DC level signal 24 is passed into the threshold detector circuit 14. The threshold detector circuit 14 comprising of a comparator with one input being set at a reference level as would be understood by those of skill in the art. The reference level is set to be slightly above the average DC level of the DC level signal 24. Thus the DC level signal 24 would be converted to a full amplitude pulse train signal 26 with each pulse on the DC level signal 24 that is above the reference level will correspond to a high pulse on the pulse train signal 26.

The pulse train signal 26 is passed into the pulse train comparator circuit 16. The pulse train comparator circuit 16 could be implemented as a microcontroller as would be understood by those skill in the art. The pulse train comparator circuit 16 would compare the input pulse train signal 26 to a plurality of internally stored pulse train. On a match the output circuit 18 is activated. Since the pulse train signal 26 is a representation of the power line disturbances the output circuit 18 is activated in response to power line disturbances. As those skilled in the art knows the power line-signals are 'dirty', meaning that there are many disturbances superimposed on the power line signal from other sources such as power line fluctuations, brown outs, other appliances etc. other than the ones the user intentionally imparted on the power line by toggling a light switch. It is therefore good practice to encode the disturbances so as to allow the pulse train comparator circuit 16 to differentiate between an actual user input from the 'dirty' signals. A simple encoding could be for the user to toggle the light switch at a particular rate etc. The encoding must be simple as it is user controlled.

The output circuit 18 provides an interface to the silence input of modern detectors. The output circuit 18 can be as simple as a output pin on a microcontroller, a transistor output or other as required by the detector.

As alternatives to the circuits described above, the activator circuit of the present invention could comprise means such as a A/D front end with DSP processing or any other means that would be appreciated by one of ordinary skill in the art. Although particular embodiments of the invention have been described in detail, it is understood that the invention is not limited correspondingly in scope, but includes all changes and modifications coming within the sprit and terms of the claims appended hereto.

The invention claimed is:

1. An activator circuit responsive to power line disturbance, said activator circuit comprising of:

a power line interface circuit, means for connecting the input of said power line interface circuit to the power line, a signal conditioning circuit, means for connecting the output of said power line interface circuit to input of said signal conditioning circuit, a threshold detector circuit, means for connecting the output of said signal conditioning circuit to input of said threshold detector circuit, a pulse train comparator circuit, means for connecting the output of said threshold detector circuit to input of said pulse train comparator circuit, an output circuit, means for connecting the output of said pulse train comparator circuit to input of said output circuit, wherein said pulse train comparator circuit will activate or de-activate said output circuit depending on a comparison of the input signal of said pulse train comparator circuit to a plurality of internally stored pulse trains representations.

2. The activator circuit of claim 1 in which the power line interface circuit consists of a step down transformer.

3. The activator circuit of claim 1 in which the signal conditioning circuit consists the means to rectify, amplify and high pass filter said input signal.

4. The activator circuit of claim 1 in which the threshold detector circuit consists of a comparator with a reference.

5. The activator circuit of claim 1 in which the pulse train comparator circuit consists of a micro-controller.

* * * * *